US008642859B1

(12) United States Patent
Valenti

(10) Patent No.: US 8,642,859 B1
(45) Date of Patent: Feb. 4, 2014

(54) STRINGED INSTRUMENT BENDING STRESS RELIEF

(71) Applicant: Mark E. Valenti, Knoxville, TN (US)

(72) Inventor: Mark E. Valenti, Knoxville, TN (US)

(73) Assignee: Safety & Security Solutions Corporation, Knoxville, TN (US)

( * ) Notice: Subject to any disclaimer, the term of this patent is extended or adjusted under 35 U.S.C. 154(b) by 27 days.

(21) Appl. No.: 13/627,388

(22) Filed: Sep. 26, 2012

(51) Int. Cl.
*G10D 3/00* (2006.01)
*G10D 3/06* (2006.01)

(52) U.S. Cl.
CPC ... *G10D 3/06* (2013.01); *G10D 3/00* (2013.01)
USPC ..... 84/293

(58) Field of Classification Search
USPC ..... 84/293
See application file for complete search history.

(56) References Cited

U.S. PATENT DOCUMENTS

| | | | | | |
|---|---|---|---|---|---|
| 465,490 | A | * | 12/1891 | Olson | 84/295 |
| 546,374 | A | * | 9/1895 | Babbitt | 84/263 |
| 557,277 | A | * | 3/1896 | Hartman | 84/267 |
| 586,032 | A | * | 7/1897 | Shelton | 84/295 |
| 1,723,751 | A | * | 8/1929 | Turturro | 84/263 |
| 1,747,650 | A | * | 2/1930 | Sawyer | 84/267 |
| 1,773,133 | A | * | 8/1930 | Faccaro | 84/275 |
| 1,887,398 | A | * | 11/1932 | Chase | 84/276 |
| 4,930,389 | A | * | 6/1990 | Kunstadt | 84/293 |
| 5,616,873 | A | | 4/1997 | Fishman et al. | |
| 5,895,872 | A | | 4/1999 | Chase | |
| 6,100,458 | A | | 8/2000 | Carrington et al. | |
| 6,791,022 | B2 | | 9/2004 | Green | |
| 6,888,055 | B2 | | 5/2005 | Smith et al. | |
| 7,112,733 | B1 | | 9/2006 | Babicz | |
| 7,462,767 | B1 | | 12/2008 | Swift | |
| 7,498,497 | B2 | | 3/2009 | Ito | |
| 7,531,729 | B1 | | 5/2009 | Davis et al. | |
| 7,645,926 | B2 | * | 1/2010 | Jerrolds | 84/263 |
| 7,687,696 | B2 | | 3/2010 | Fox | |
| 7,795,513 | B2 | | 9/2010 | Luttwak | |
| 8,519,247 | B2 | * | 8/2013 | Mitchell | 84/293 |

* cited by examiner

*Primary Examiner* — Robert W Horn
(74) *Attorney, Agent, or Firm* — Luedeka Neely Group, P.C.; Rick Barnes; Stephen D. Adams

(57) ABSTRACT

A stringed musical instrument including a body connected to a neck and including a stress modification system for reducing bending stress in the neck. The stress modification system includes a first anchor and second anchor, each mounted at a proximal end of the neck on a top and bottom surface, respectively. The system further includes a diverter for guiding the string from the first anchor to the second anchor and for equalizing the tension along the string from the first anchor to the second anchor. The diverter may include one of a pulley, a roller, a wheel, and a low-friction pad. The first anchor or second anchor may include a tensioner for modifying the tension in the string. The bottom surface of the neck may include a recessed channel in which the string is disposed. In certain other embodiments, at least a portion of the neck is hollow.

20 Claims, 6 Drawing Sheets

STRINGED INSTRUMENT BENDING STRESS RELIEF

FIELD

This invention relates to the field of musical instruments. More particularly, this invention relates to modifying bending stresses in a string instrument, such as reducing or eliminating such stresses.

BACKGROUND

The weight of an instrument is often a concern for musicians. In particular, musicians who move while playing their instrument or who must transport their instrument regularly from one place to another place very often want to reduce the weight of the instrument. In that regard, there have been many attempts to reduce instrument weight to overcome these concerns. With respect to stringed instruments, one way to reduce the weight of the instrument is to reduce the weight or density of the materials used in its construction. However, lightweight materials are often an inadequate alternative because they tend to fail under the stresses inherent in the design and use of the instrument. In particular, stringed instruments generally require fairly taut strings in order to vibrate and produce a desired tone. As a string is tightened, various stresses are produced in the instrument, including bending stresses. Lightweight materials often lack the strength that is sufficient to withstand these stresses, and fail as a result.

What is needed, therefore, is a system that tends to reduce problems such as those described above, at least in part.

SUMMARY

The above and other needs are met by a stringed musical instrument including a body, a neck and a stress modification system for reducing bending stress in the neck. In some embodiments, the musical instrument is a guitar.

The body includes a proximal end and a distal end. In certain embodiments, the body is substantially solid.

The neck includes a proximal end, a distal end, an upper surface, a lower surface and a string surface. The string surface is located between the proximal end and the distal end on the upper surface of the neck. The distal end of the neck may be attached to the proximal end of the body. In some embodiments, the lower surface of the neck is an interior surface of the neck. In other embodiments, the lower surface of the neck comprises a recessed channel in which the string is disposed. In certain other embodiments, at least a portion of the neck is hollow. In other embodiments, the neck comprises a first lightweight material. For example, the first lightweight material may include aluminum, titanium, foam, wood, fiberglass, carbon, or a combination thereof. In certain other embodiments, the neck is formed of honeycomb-shaped aluminum.

The stress modification system includes a first anchor, a second anchor, and a diverter. The first anchor is mounted onto the upper surface of the neck near the proximal end of the neck The first anchor attaches a first end of a string to the instrument at a first location. The second anchor is mounted onto the lower surface of the neck near the proximal end of the neck. The second anchor attaches a second end of the string to the instrument at a second location. In certain embodiments, at least one of the first anchor and the second anchor includes a tensioner for modifying the tension in the string.

The diverter may be mounted at various locations on the instrument including near the distal end of the neck or the distal end of the body. The diverter guides the string from the first anchor, over the string surface on the upper surface of the neck, around the distal end of the neck, and back along the lower surface of the neck to the second anchor. Additionally, the diverter equalizes the tension along the string from the first anchor to the second anchor. In certain embodiments, the diverter comprises at least one of a pulley, a roller, a wheel, and a low-friction pad.

DRAWINGS

Further advantages of the invention are apparent by reference to the detailed description when considered in conjunction with the figures, which are not to scale so as to more clearly show the details, wherein like reference numbers indicate like elements throughout the several views, and wherein.

DESCRIPTION

Figure 1:
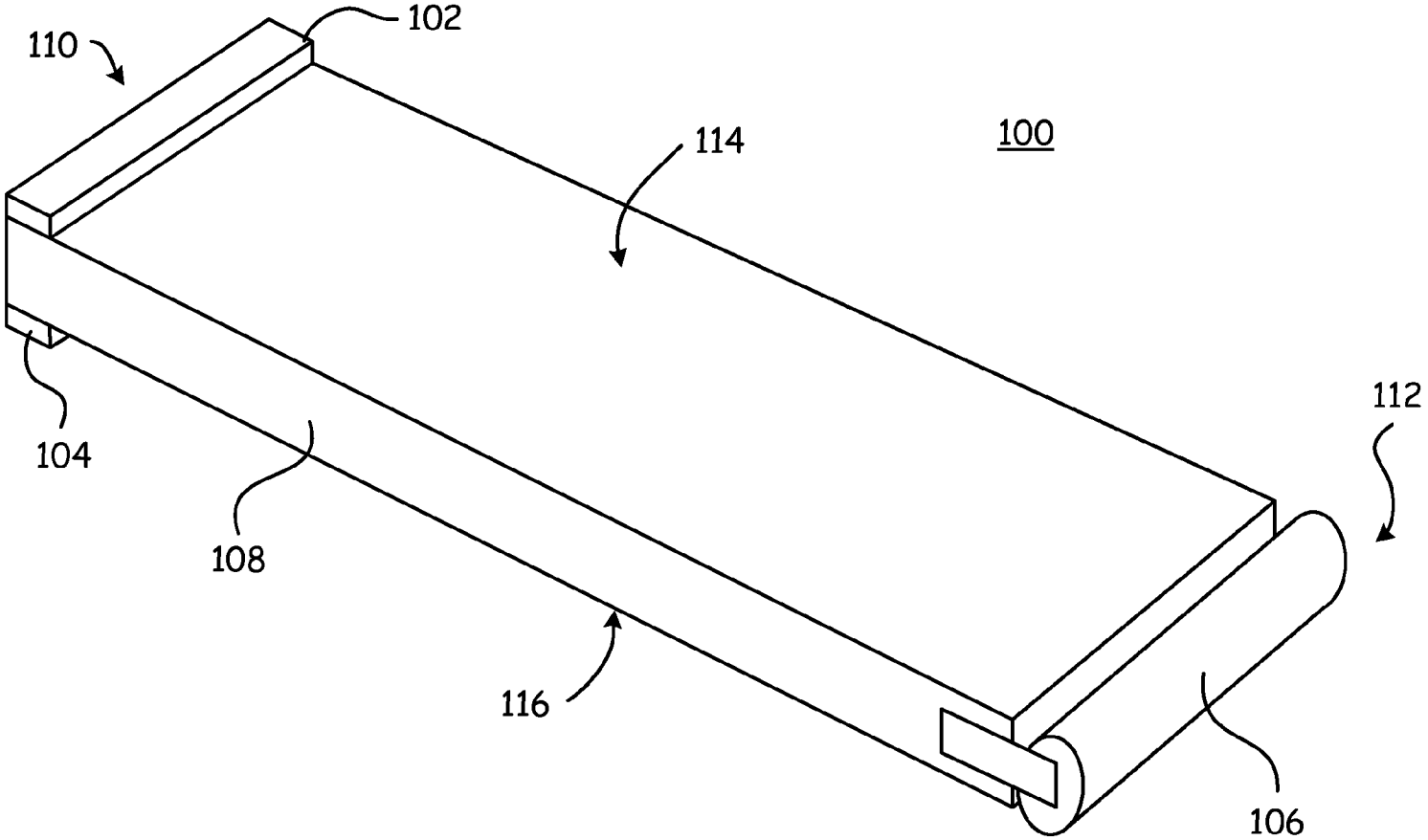
FIG. 1 is a perspective view of a first embodiment of an instrument neck according to the present invention.

With reference now to FIG. 1, there is depicted a stress modification system for modifying stress in a stringed instrument in accordance with one embodiment of the present invention, generally indicated with the reference numeral 100. The stress modification system 100 is comprised of a plurality of components. Such components in their broadest context include a first anchor 102, a second anchor 104, and a diverter 106. Such components are individually configured and correlated with respect to each other so as to obtain the desired objective.

The system 100 may be mounted to an elongate instrument neck 108, such as a guitar, violin, or mandolin neck. The neck 108 generally has a proximate end 110 and a distal end 112, a top 114 and a bottom 116.

Figure 2:
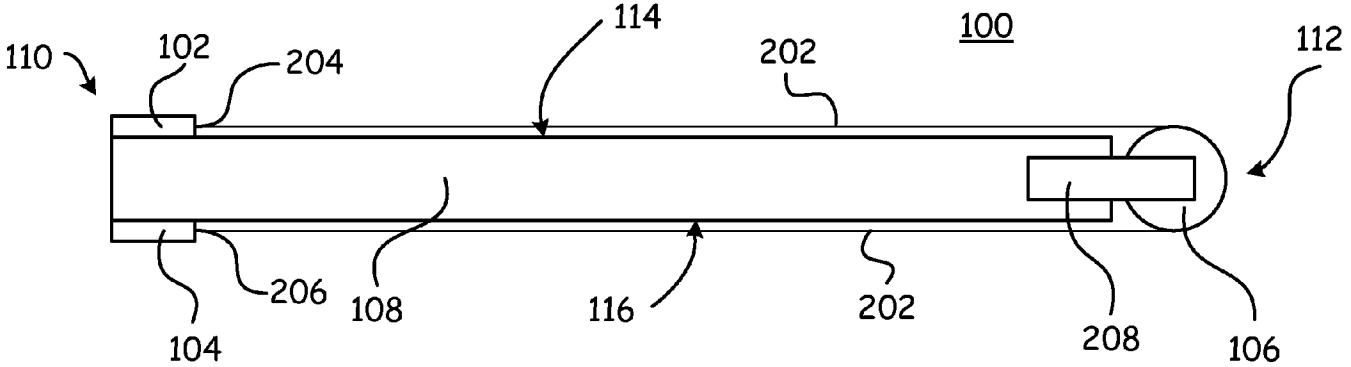
FIG. 2 is a front elevational view of the first embodiment.
Figure 3:
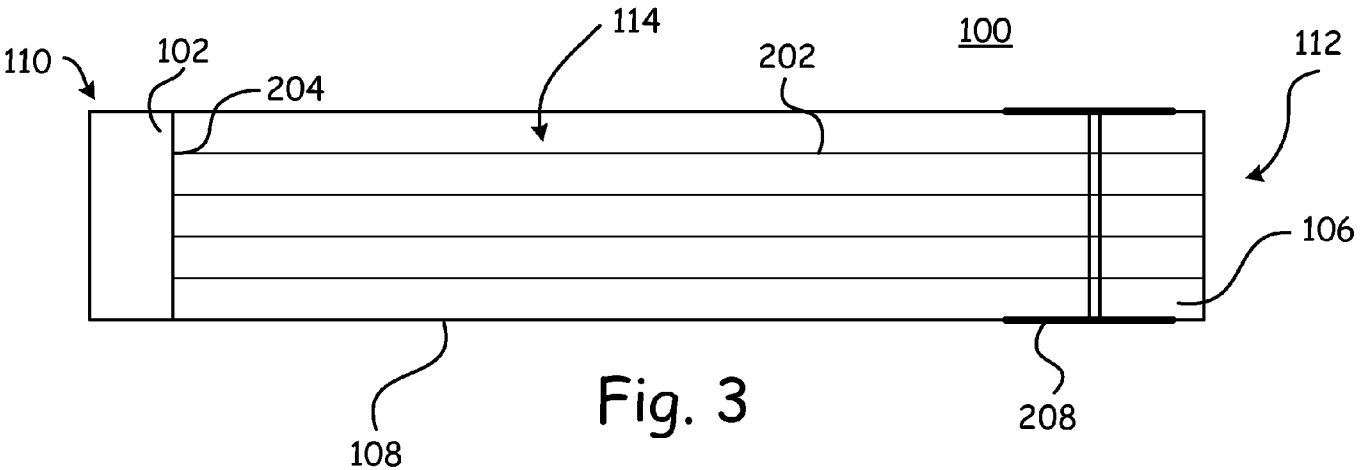
FIG. 3 is a top plan view of the first embodiment.

With reference to FIGS. 2 and 3, the first anchor 102 and second anchor 104 may comprise any implement sufficient for securing a wire, rope or other string-like material. For example, the anchors 102, 104 may comprise hooks, posts or pegs. The first anchor 102 may be configured for mounting onto the top 114 adjacent the proximate end 110 of the neck 108. The first anchor 102 is configured to receive a portion of a string 202 and to attach the string to a first location 204 near the proximate end 110 of the neck 108. Similarly, the second anchor 104 may be configured for mounting on the bottom 116 adjacent the proximate end 110 of the neck 108. The second anchor 104 may be configured to receive a portion of a string 202 and to attach the string to a second location 206 near the proximate end 110 of the neck 108.

The diverter 106 may comprise at least one of a pulley, a roller, a wheel and a low-friction pad. One purpose of the diverter 106 is to balance the stresses in the strings 202 as compared to the top 114 and the bottom 116 of the neck 108. The balanced top stresses 114 and bottom stresses 116 tend to eliminate most or all bending forces. Thus, any structure that substantially accomplishes this purpose is comprehended by the representational diverter 112 as depicted. The diverter 106 may be mounted onto a portion of the neck 108. In some embodiments, the diverter 106 is mounted near the distal end 112 of the neck 108. The diverter 106 may be configured to receive one or more strings 202 from the first anchor 102. The diverter 106 guides the string over the top 114, over the distal end 112 of the neck 108, and back along the bottom 116 to the second anchor 104. The diverter 106 may be connected to the neck 108 using a mounting bracket 208. In the embodiment as depicted in FIG. 2, the bracket 208 permits the diverter 106 to rotate freely and with minimal force and friction.

Figure 4:
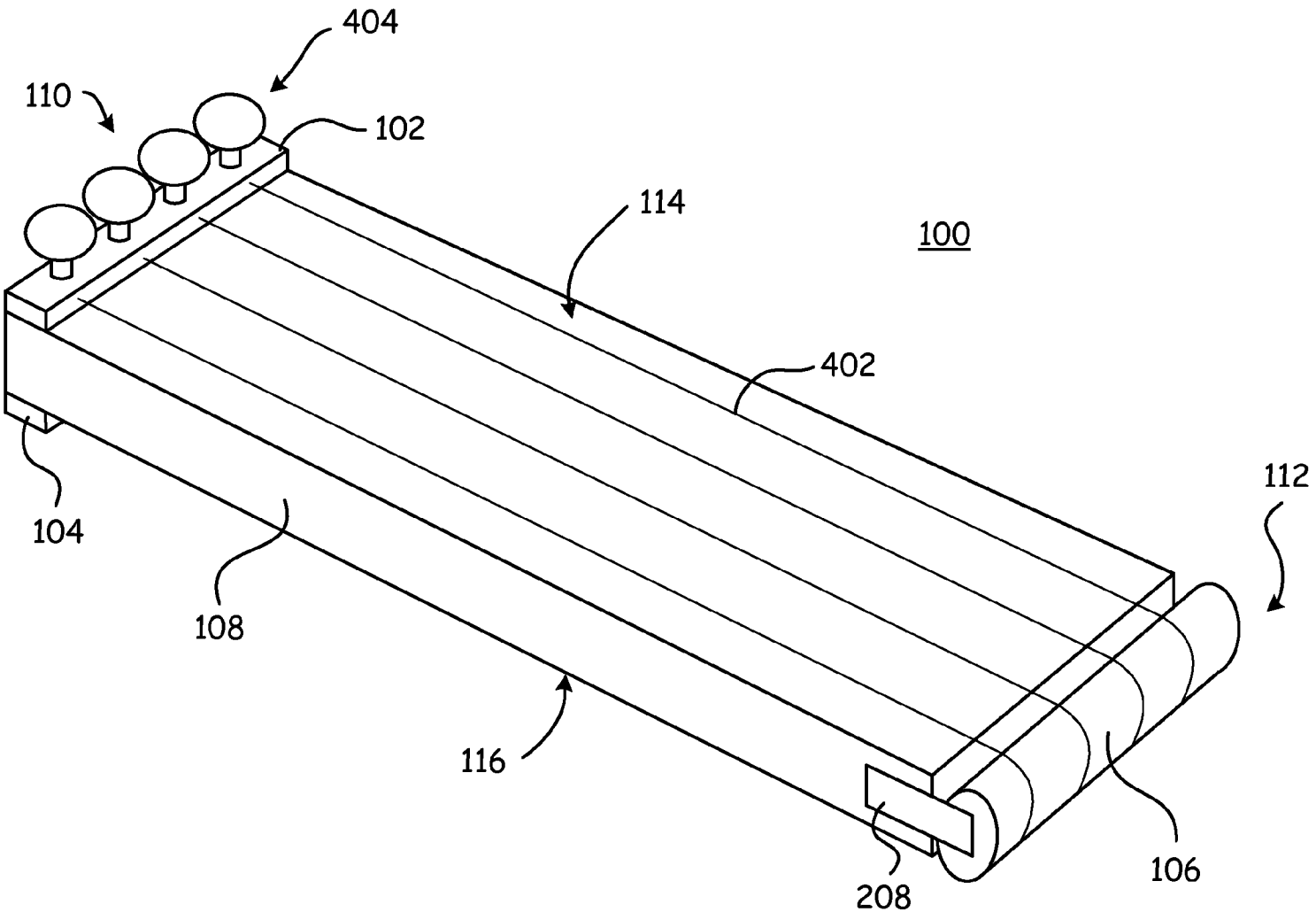
FIG. 4 is a perspective view of a second embodiment of an instrument neck according to the present invention, including tensioners for the strings.

In operation, a string 202 is connected to the first location 204 and extended over the top 114 of the neck, seated on the diverter 106, extended over the bottom 116 and then connected to the second location 206. The tension in the string 202 may be increased or decreased. For example, as shown in FIG. 4, tuning pegs 404 may be provided to increase or decrease the string 202 tension. Alternatively, the tension in the string 202 may be increased by lengthening the distance between the diverter 106 and the first location 204 or second location 206, or both (FIG. 2). For example, lengthening the bracket 208 would cause the tension in the string to increase.

A person of skill in the art will recognize that a bending moment is created if tension in the string 402 on the top 114 and bottom 116 are unbalanced. The bending moment would cause the neck to bow or arch, causing one side of the neck 108 to be placed into compression and the opposite side of the neck to be placed in tension. If the bending forces generated in the neck 108 are greater than the tensile or compressive strength of the neck material, the neck will likely fail.

These types of failures are common when lightweight building materials are used in the construction of musical instruments. In particular, lightweight materials such as plastic, foam, etc., often have lower tensile and compressive strengths than heavier materials. Of course, there are some materials, such as reinforced fibers or specialty metals, which are lightweight and provide high strength. However, high costs are often associated with these materials, making them impractical for the mass production of consumer products, such as musical instruments.

The present invention provides a system that overcomes these shortcomings and allows a lightweight material to be used in the construction of a musical instrument without causing the material to fail due to bending forces. In particular, by equalizing the tensile and compressive forces in the neck 108, the bending moment is minimized or reduced and materials having relatively low strength can be used in the construction of the neck. For example, in some embodiments, the neck 108 may comprise foam, plastic or lightweight woods such as balsa wood, other lightweight composites, aluminum, titanium, fiberglass, carbon, or a combination thereof. In other embodiments, the neck 108 may be at least partially hollow. In certain other embodiments, an at least partially hollow neck 108 comprising a first lightweight material may be filled with a one or more other lightweight materials such as those previously described or other similar lightweight materials.

Equalization is accomplished by positioning the anchors 102, 104 at a substantially equivalent distance from the diverter 106. In that way, the tensile force in the portion of the string 202 over the top 114 is substantially equivalent to the tensile force in the portion of the string over the bottom 116. The distance between the anchors 102, 104 and the diverter 106 should be substantially equal in order to reduce or eliminate the bending moment in the neck 108.

Figure 5:
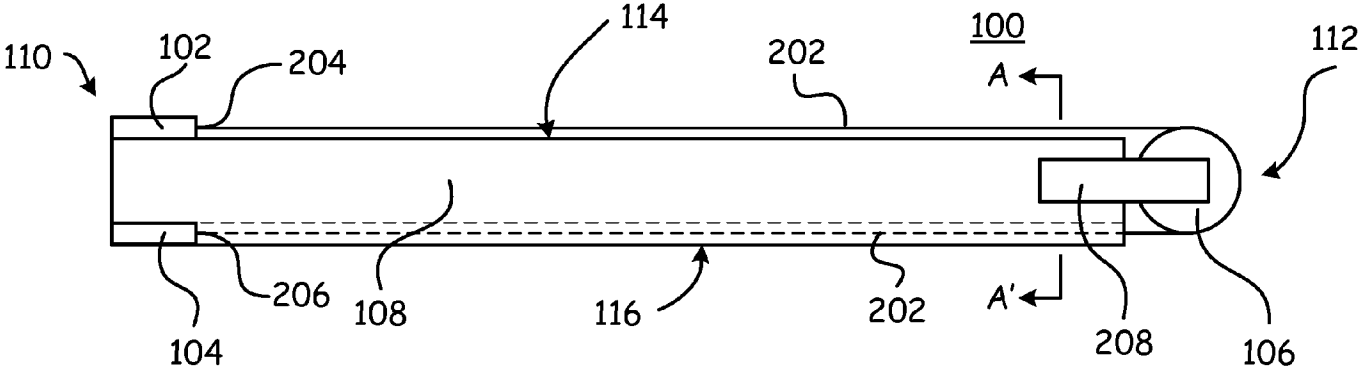
FIG. 5 is a front elevation view of a third embodiment of an instrument neck according to the present invention, including a channel for the strings.
Figure 6:
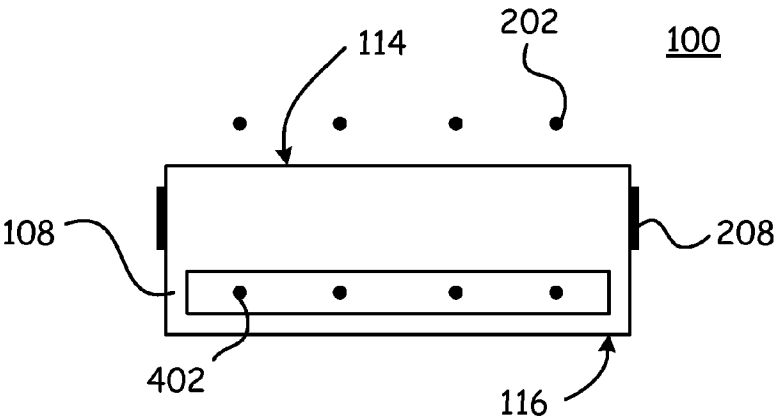
FIG. 6 is a sectional view of the second embodiment shown from A-A.

In certain embodiments, at least a portion of the string 202 may be concealed or covered. For example, as shown in FIGS. 5 and 6, a channel 402 provided within the neck 108 of the instrument conceals the portion of the string 202 extending from the diverter 106 along the bottom 116 to the second anchor 104. In other embodiments, the bottom 116 may further comprise a recessed channel, or a detachable cover may be positioned over a portion of the neck 108 to conceal a portion of the string 202. By concealing or covering a portion of the string 202, a user can handle the instrument neck 108 without interfering with the string 202.

Figure 7:
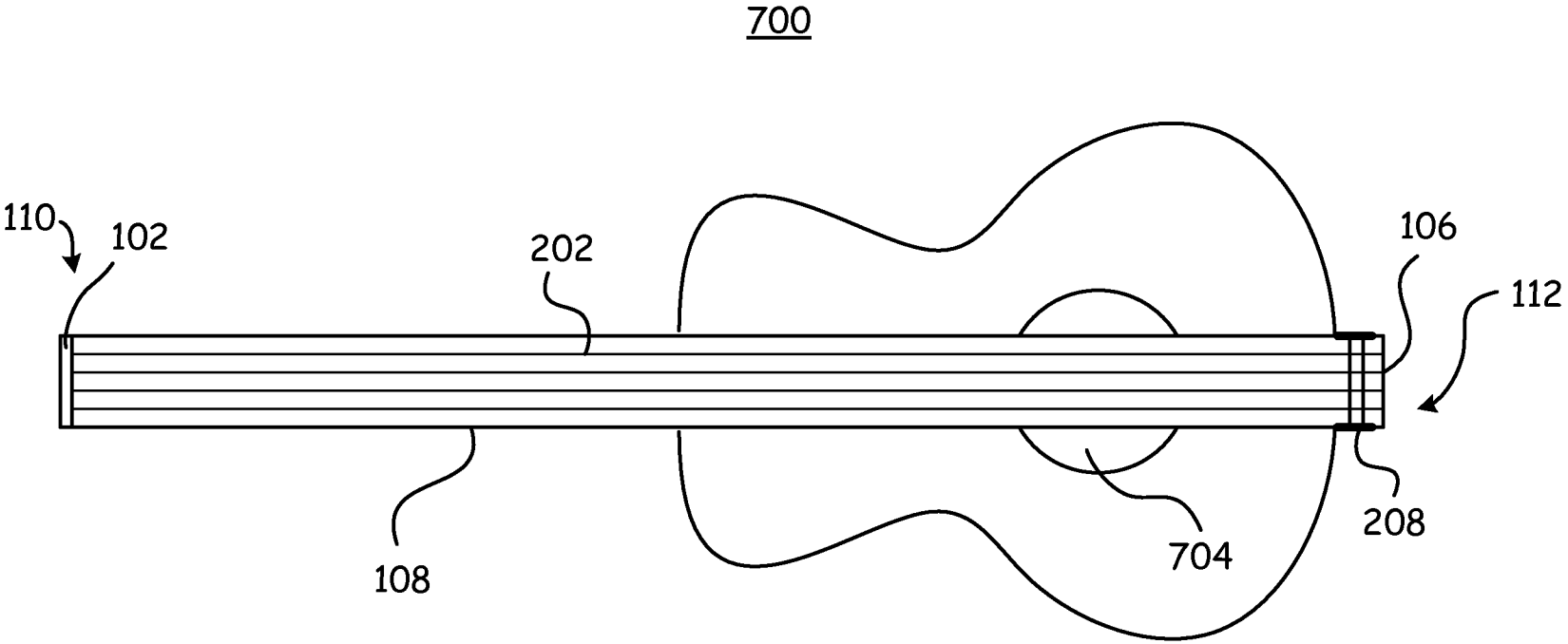
FIG. 7 is a top plan view of a fourth embodiment of an instrument neck according to the present invention, including an instrument body.
Figure 8:
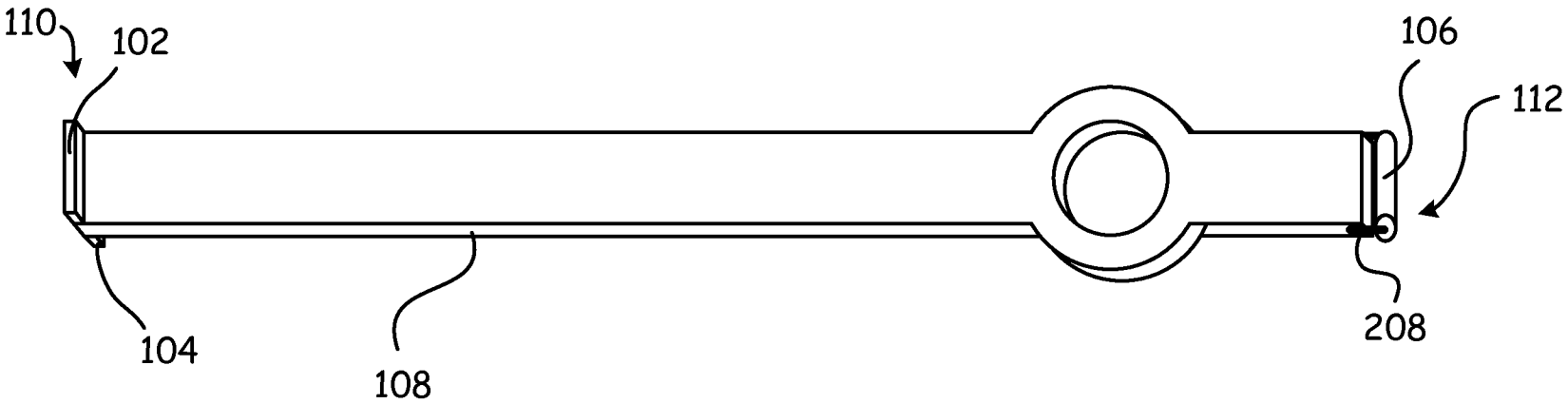
FIG. 8 is a perspective view of a fifth embodiment of an instrument neck according to the present invention, including a centrally located sound port.

As shown in FIG. 7, in some embodiments, an instrument 700 is provided, which includes a neck 108 that may be connected to an instrument body 702. In certain embodiments, the instrument body 702 may include a sound hole 704 for allowing sound waves to be reverberated within the instrument body 702. As shown, the neck 108 may be extended either partially or entirely across the length of the instrument body 702. In other embodiments, as shown in FIG. 8, the neck 108 may include a sound port 802 formed into the neck. The sound port 802 allows sound waves to travel into the instrument body 702 while minimizing interference by the neck 108.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A stress modification system for modifying stresses in a musical instrument, the stress modification system comprising:

a first anchor configured for mounting onto an upper surface of the instrument, the first anchor for attaching a first end of a string to the instrument at a first location disposed at a proximal end of the instrument, a second anchor configured for mounting onto a lower surface of the instrument, the second anchor for attaching a second end of the string to the instrument at a second location disposed at the proximal end of the instrument, and a diverter configured for mounting onto an instrument and for guiding the string from the first anchor, over the upper surface of the instrument, over a distal end of the instrument, and back along the lower surface of the instrument to the second anchor, the diverter further for equalizing tension along the string from the first anchor to the second anchor.

2. The stress modification system of claim 1, wherein the diverter comprises at least one of a pulley, a roller, a wheel, and a low-friction pad.

3. An instrument neck assembly comprising:

an elongate neck comprising a proximal end, a distal end and a string surface disposed between the proximal end and the distal end, and a stress modification system for modifying stresses in the neck, the stress modification system comprising:

a first anchor disposed on an upper surface of the neck for attaching a first end of a string to the neck at a first location proximate the proximal end of the neck, a second anchor disposed on a lower surface of the neck for attaching a second end of the string to the neck at a second location proximate the proximal end of the neck, and a diverter for guiding the string from the first anchor to the second anchor, the diverter further for equalizing tension along the string from the first anchor to the second anchor, wherein at least one of the first anchor and the second anchor comprise a tensioner for modifying the tension in the string.

4. The instrument neck assembly of claim 3, wherein the diverter comprises at least one of a pulley, a roller, a wheel, and a low-friction pad.

5. The instrument neck assembly of claim 3, wherein the diverter is disposed proximate the distal end of the neck to guide the string from the first anchor, over the upper surface and string surface, over the distal end of the neck, and along the lower surface back to the second anchor.

6. The instrument neck assembly of claim 3, wherein the lower surface of the neck is an interior surface of the neck.

7. The instrument neck assembly of claim 3, wherein the lower surface of the neck comprises a recessed channel in which the string is disposed.

8. The instrument neck assembly of claim 3, wherein at least a portion of the neck is hollow.

9. The instrument neck assembly of claim 3, wherein the neck is filled with foam.

10. A stringed musical instrument comprising:

a body comprising a proximal end and a distal end, a neck comprising a proximal end, a distal end, an upper surface, a lower surface, and a string surface disposed between the proximal end and the distal end on the upper surface, the distal end of the neck attached to the proximal end of the body, and a stress modification system for reducing bending stresses in the neck, the stress modification system comprising:

a first anchor mounted onto the upper surface of the neck proximate the proximal end of the neck, the first anchor for attaching a first end of a string to the instrument at a first location, a second anchor mounted onto the lower surface of the neck proximate the proximal end of the neck, the second anchor for attaching a second end of the string to the instrument at a second location, and a diverter disposed proximate the distal end of the neck for guiding the string from the first anchor, over the string surface on the upper surface of the neck, around the distal end of the neck, and back along the lower surface of the neck to the second anchor, the diverter further for equalizing tension along the string from the first anchor to the second anchor, wherein at least one of the first anchor and the second anchor comprise a tensioner for modifying the tension in the string.

11. The musical instrument of claim 10, wherein the diverter comprises at least one of a pulley, a roller, a wheel, and a low-friction pad.

12. The musical instrument of claim 10, wherein the lower surface of the neck is an interior surface of the neck.

13. The musical instrument of claim 10, wherein the lower surface of the neck comprises a recessed channel in which the string is disposed.

14. The musical instrument of claim 10, wherein at least a portion of the neck is hollow.

15. The musical instrument of claim 10, wherein the body is substantially solid.

16. The musical instrument of claim 10, wherein the musical instrument is a guitar.

17. The musical instrument of claim 10, wherein the neck comprises aluminum, titanium, foam, wood, fiberglass, carbon, or a combination thereof.

18. The musical instrument of claim 10, wherein the neck is formed of honeycomb-shaped aluminum.

19. The musical instrument of claim 10, wherein the neck is filled with foam.

20. The musical instrument of claim 10, wherein the string is in two parts.

* * * * *